US010189630B2

(12) United States Patent
Vadlamani et al.

(10) Patent No.: US 10,189,630 B2
(45) Date of Patent: Jan. 29, 2019

(54) MICROWAVABLE FOOD PRODUCTS AND CONTAINERS

(71) Applicant: CAMPBELL SOUP COMPANY, Camden, NJ (US)

(72) Inventors: Keswara Rao Vadlamani, Marlton, NJ (US); Mark Robert Watts, Marlton, NJ (US)

(73) Assignee: Campbell Soup Company, Camden, NJ (US)

( * ) Notice: Subject to any disclaimer, the term of this patent is extended or adjusted under 35 U.S.C. 154(b) by 428 days.

(21) Appl. No.: 13/770,655

(22) Filed: Feb. 19, 2013

(65) Prior Publication Data

US 2014/0231419 A1 Aug. 21, 2014

(51) Int. Cl.
*H05B 6/80* (2006.01)
*A21D 10/02* (2006.01)
(Continued)

(52) U.S. Cl.
CPC ..... *B65D 81/3453* (2013.01); *B65D 51/20* (2013.01); *B65D 2251/0015* (2013.01);
(Continued)

(58) Field of Classification Search
CPC .... B65D 2251/0015; B65D 2251/0093; B65D 2581/3404; B65D 2581/3472; B65D 2581/3493; B65D 51/20; B65D 81/3453
(Continued)

(56) References Cited

U.S. PATENT DOCUMENTS 3,191,520 A * 6/1965 Halter ..... B65D 1/36 220/573.1
4,133,996 A * 1/1979 Fread ..... A47J 29/00 219/729

(Continued)

FOREIGN PATENT DOCUMENTS

JP 03029780 A * 2/1991

OTHER PUBLICATIONS

The Cool Science Dad_Making an Egg Yolk Float; Connors Curiosities_ The Magic Floating Egg.*

*Primary Examiner* — Dana Ross
*Assistant Examiner* — Ket D Dang
(74) *Attorney, Agent, or Firm* — Pauly, DeVries Smith & Deffner LLC

(57) ABSTRACT

Embodiments of the invention include food products and related methods. In an embodiment, the invention includes a food product. The food product can include a container and a food composition. The container can include a bottom wall and a side wall. The bottom wall can include a microwave reflector. The side wall can include a material that is substantially transparent to microwaves. The microwave reflector can cover at least about 80 percent of the surface area of the bottom wall. In an embodiment, the invention includes a microwaveable food container. The microwaveable food container can include a bottom wall and a side wall. The bottom wall can include a microwave reflector. The side wall can include a material that is substantially transparent to microwaves. The microwave reflector can cover at least about 80 percent of the surface area of the bottom wall. Other embodiments are also included herein.

23 Claims, 14 Drawing Sheets

(51) Int. Cl.
*B42F 17/08* (2006.01)
*B65D 81/34* (2006.01)
*B65D 51/20* (2006.01)

(52) U.S. Cl.
CPC ..... *B65D 2251/0093* (2013.01); *B65D 2581/3404* (2013.01); *B65D 2581/3472* (2013.01); *B65D 2581/3493* (2013.01)

(58) Field of Classification Search
USPC ..... 219/728, 678, 725–726, 730, 734, 744, 219/746, 729, 732, 735, 762, 763, 1.55 E, 219/1.55 M, 1.55 R, 1.55 F, 724, 736, 219/731; 426/107, 234, 113, 118, 241, 426/243; 99/DIG. 14, 451; 220/423, 220/424, 258.2, 612, 359.1, 258.5, 359.2, 220/212.5, 212, 270, 276, 780, 574.1; 126/390, 375, 246
See application file for complete search history.

(56) References Cited

U.S. PATENT DOCUMENTS 4,416,907 A 11/1983 Watkins
4,495,392 A * 1/1985 Derby ..... A47J 36/027 219/729
4,626,641 A 12/1986 Brown
4,641,005 A 2/1987 Seiferth
4,656,325 A 4/1987 Keefer
4,661,672 A 4/1987 Nakanaga
4,683,362 A 7/1987 Yangas
4,698,472 A * 10/1987 Cox ..... H05B 6/6408 219/728
4,735,513 A 4/1988 Watkins et al.
4,851,631 A * 7/1989 Wendt ..... B65D 81/3453 219/729
4,927,991 A 5/1990 Wendt et al.
4,990,735 A * 2/1991 Lorenson ..... B65D 81/3446 219/728
4,992,638 A * 2/1991 Hewitt ..... B65D 81/3453 219/728
5,006,684 A 4/1991 Wendt et al.
5,079,396 A * 1/1992 Katz ..... A47J 31/053 219/689
5,230,914 A 7/1993 Akervik
5,298,708 A 3/1994 Babu et al.
5,310,980 A * 5/1994 Beckett ..... 219/709
5,370,883 A 12/1994 Saunier
5,372,828 A 12/1994 Le
5,416,304 A 5/1995 De La Cruz et al.
5,428,209 A 6/1995 Babu et al.
5,468,939 A 11/1995 MacLean
5,861,184 A 1/1999 Ishino et al.
5,986,248 A * 11/1999 Matsuno ..... B65D 81/3453 219/728
6,102,281 A 8/2000 Lafferty et al.
6,486,455 B1 * 11/2002 Merabet ..... B65D 81/3453 219/725
6,696,677 B2 2/2004 Kennedy
6,777,655 B2 * 8/2004 Zhang ..... A23L 1/0128 219/725
6,852,958 B2 2/2005 Germain et al.
7,183,527 B2 * 2/2007 Germain ..... B65G 15/58 219/701
7,345,263 B2 * 3/2008 Hechler, IV ..... 219/729
2003/0209542 A1 * 11/2003 Harris ..... H05B 6/782 219/696
2005/0109772 A1 5/2005 Thorpe et al.
2005/0199619 A1 * 9/2005 Richardson ..... B65D 15/14 219/728
2005/0284865 A1 12/2005 Fogle et al.
2006/0118552 A1 6/2006 Tiefenback
2007/0284368 A1 * 12/2007 Richardson ..... B65D 17/163 219/725
2008/0064085 A1 * 3/2008 McArdle ..... H05B 6/6494 435/287.2
2009/0304872 A1 * 12/2009 Chouikhi ..... B65D 81/3453 426/107
2010/0230403 A1 9/2010 Hodson et al.
2010/0252550 A1 * 10/2010 Dunn ..... H05B 6/78 219/700
2011/0123682 A1 * 5/2011 Perry ..... B65D 81/2076 426/107

* cited by examiner

MICROWAVABLE FOOD PRODUCTS AND CONTAINERS

FIELD OF THE INVENTION

The present invention relates to microwaveable food products, microwaveable containers and related methods.

BACKGROUND OF THE INVENTION

Beginning with its commercial introduction in the late 1940s, microwave cooking has been employed to quickly and efficiently cook various food items such as soups, frozen dinners, deserts, main dishes, side dishes, appetizers, and the like.

A microwave oven works by passing non-ionizing microwave radiation through the food to be heated. Microwave electromagnetic radiation is usually at a frequency of about 2.45 gigahertz (GHz) or, in large industrial/commercial ovens, at 915 megahertz (MHz). Water, fat, and other substances in the food absorb energy from the microwaves in a process called dielectric heating. Polar molecules (such as water) rotate as they try to align themselves with the alternating electric field of the microwaves. Rotating molecules hit other molecules and put them into motion, thus generating heat.

The cooking chamber of a microwave oven is similar to a Faraday cage and prevents the waves from coming out of the oven. The oven door usually has a window for easy viewing, but the window has a layer of metal mesh which prevents the microwaves from exiting the oven.

SUMMARY OF THE INVENTION

Embodiments of the invention include food products and related methods. In an embodiment, the invention includes a food product. The food product can include a container and a food composition. The container can include a bottom wall and a side wall. The bottom wall can include a microwave reflector. The microwave reflector covers at least about 80 percent of the surface area of the bottom wall. The side wall can include a material that is substantially transparent to microwaves.

In an embodiment, the invention includes a microwaveable food container. The microwaveable food container can include a bottom wall and a side wall. The bottom wall can include a microwave reflector. The microwave reflector covers at least about 80 percent of the surface area of the bottom wall. The side wall can include a material that is substantially transparent to microwaves.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present invention is defined by the appended claims and their legal equivalents.

BRIEF DESCRIPTION OF THE FIGURES

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

The embodiments of the present invention described herein are not intended to be exhaustive or to limit the invention to the precise forms disclosed in the following detailed description. Rather, the embodiments are chosen and described so that others skilled in the art can appreciate and understand the principles and practices of the present invention.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

While use of a microwave oven to heat foods is tremendously fast and convenient, it sometimes leads to localized superheating of components in the food. In some instances, this can lead to the rapid vaporization of water causing popping sounds, expelling food from the container, and in some cases generating enough force to tip the food container.

Microwave reflective materials generally reflect off of both surfaces (e.g., microwave radiation incident on the top surface of a reflector will reflect off the top and microwave radiation incident on the bottom surface of a reflector will reflect off the bottom). Despite this property, it has been found that placement of a microwave reflector that covers the bottom of a food container (e.g., positioned under the food content when it is in a microwave oven) reduces the amount of localized superheating of components that takes place near the bottom of the food container to a remarkable degree. This effect was unexpected when considering that the reflector was not positioned directly between the magnetron (source of microwave radiation in the microwave oven) and the food container. While not intending to be bound by theory, it is believed that this effect is related to an unexpected quantity of microwave radiation that enters the food container purely through the bottom when the bottom does not include a microwave reflector.

As such, embodiments herein can promote uniform heating of foods during microwave heating. In various embodiments, localized superheating in the area near the bottom of the container can be reduced or eliminated.

Figure 1:
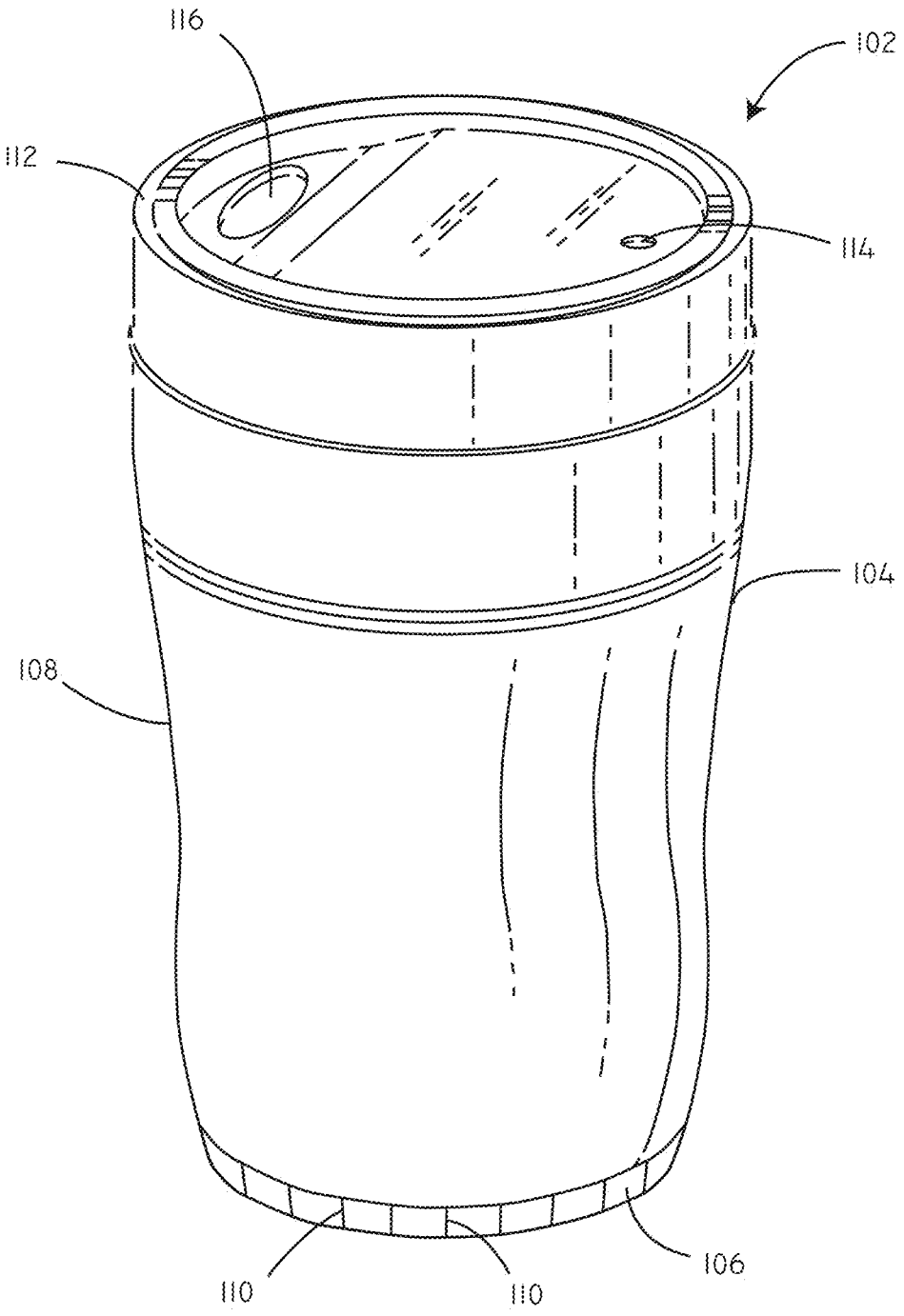
FIG. 1 is a schematic perspective view of a microwaveable food product and container in accordance with various embodiments herein.

Referring now to FIG. 1, the food product 102 includes a container 104. The container 104 includes a side wall 108. The side wall can be circular or ovoid in cross-section. In some embodiments, the side wall can be square, rectangular, or otherwise polygonal in cross-section. In some embodiments, the side wall can have an irregular shape in cross-section.

The container 104 can also include a bottom wall (not shown in this view). The container 104 includes a microwave reflector 106. The microwave reflector 106 can include a plurality of cut lines 110. The cut lines 110 can facilitate fitting the peripheral edge of the microwave reflector 106 to the bottom of the container 104. In some embodiments, the food product 102 can also include removable cap 112. The removable cap 112 can include one or more vents 114. The removable cap 112 can also include an aperture 116 through which the food product can be poured out or otherwise consumed.

Figure 2:
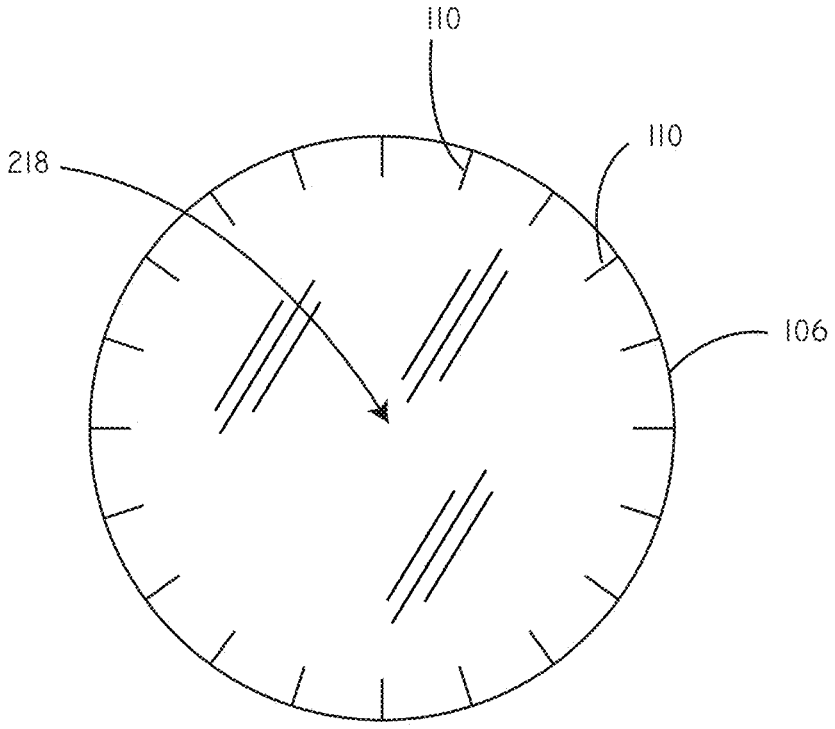
FIG. 2 is a plan view of a microwave reflector in accordance with various embodiments herein.

Referring now to FIG. 2, a microwave reflector 106 is shown. In this view, the cut lines 110 are visible. The cut lines 110 can be oriented radially with respect to the center 218 of the microwave reflector 106. In some embodiments, the microwave reflector 106 can have a circular shape. In other embodiments, the microwave reflector 106 can have other shapes.

While not intending to be bound by theory, it is believed that the if the microwave reflector 106 does not cover a sufficient percentage of the surface area of the bottom wall, then the microwaveable container will not prevent localized superheating near the bottom of the container adequately. In some embodiments, the microwave reflector covers at least about 50 percent of the surface area of the bottom wall. In some embodiments, the microwave reflector covers at least about 60 percent of the surface area of the bottom wall. In some embodiments, the microwave reflector covers at least about 70 percent of the surface area of the bottom wall. In some embodiments, the microwave reflector covers at least about 80 percent of the surface area of the bottom wall. In some embodiments, the microwave reflector covers at least about 85 percent of the surface area of the bottom wall. In some embodiments, the microwave reflector covers at least about 90 percent of the surface area of the bottom wall. In some embodiments, the microwave reflector covers at least about 95 percent of the surface area of the bottom wall. In some embodiments, the microwave reflector covers at least about 98 percent of the surface area of the bottom wall. In some embodiments, the microwave reflector covers at least about 99 percent of the surface area of the bottom wall. In some embodiments, the microwave reflector covers at least about 100 percent of the surface area of the bottom wall.

In various embodiments, 100% of the area within 1 cm of the perimeter of the bottom wall is covered by the reflector. In various embodiments, 100% of the area within 2 cm of the perimeter of the bottom wall is covered by the reflector. In various embodiments, 100% of the area within 3 cm of the perimeter of the bottom wall is covered by the reflector. In various embodiments, 100% of the area within 4 cm of the perimeter of the bottom wall is covered by the reflector.

In embodiments wherein less than 100 percent of the bottom wall is covered by a reflector, the coverage can be positioned over the outermost perimeter of the bottom wall of the container, leaving a central zone lacking coverage. Thus, in some embodiments where 80% of the bottom wall is covered, the remaining 20 percent that is uncovered can be located in the center area of the bottom wall.

Figure 3:
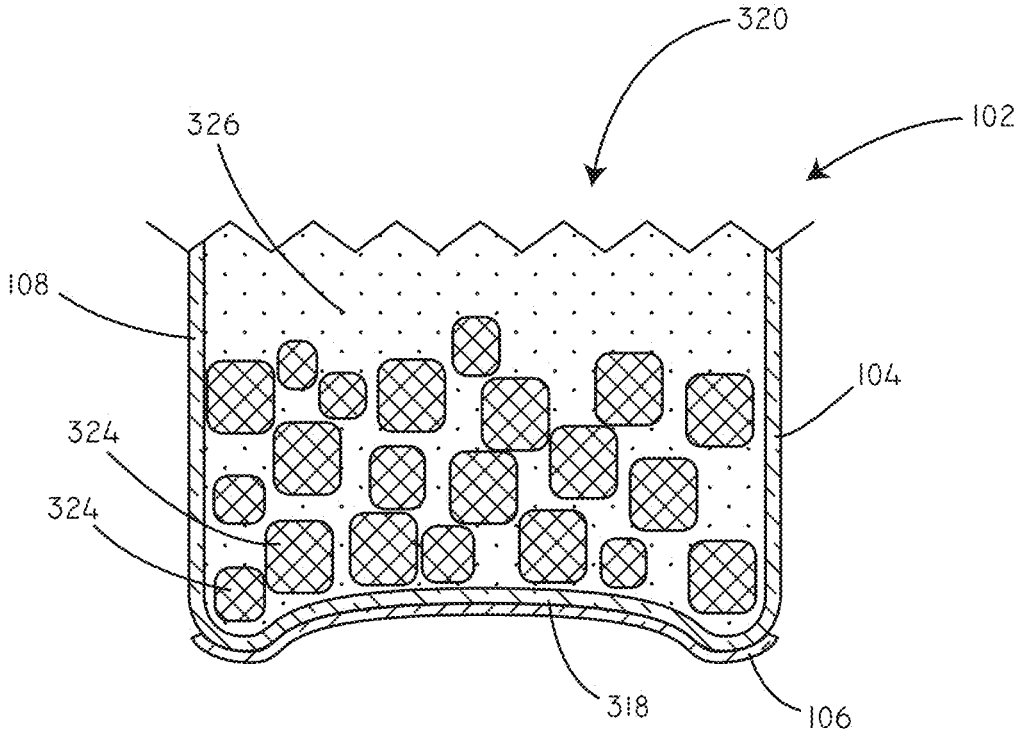
FIG. 3 is a schematic cross-sectional view of a microwaveable food product and container in accordance with various embodiments herein.

Referring now to FIG. 3, the food product 102 includes a container 104 and a food composition 320 disposed inside the container 104. The container 104 includes a bottom wall 318 and a side wall 108. A microwave reflector 106 is disposed on the bottom wall 318. The container 104 can include a layer of adhesive (not shown in this view). The adhesive can serve to hold the microwave reflector 106 onto the bottom wall 318. The food composition 320 can include solid matter 324. The food composition 320 can also include a liquid 326. Aspects of exemplary food compositions are discussed in greater detail below.

FIG. 3 shows the microwave reflector 106 disposed on the outside of the bottom wall 318. However, it will be appreciated that the microwave reflector 106 can also be disposed on the inside of the bottom wall 318. In some embodiments, the microwave reflector 106 can also be embedded within the bottom wall 318.

Figure 4:
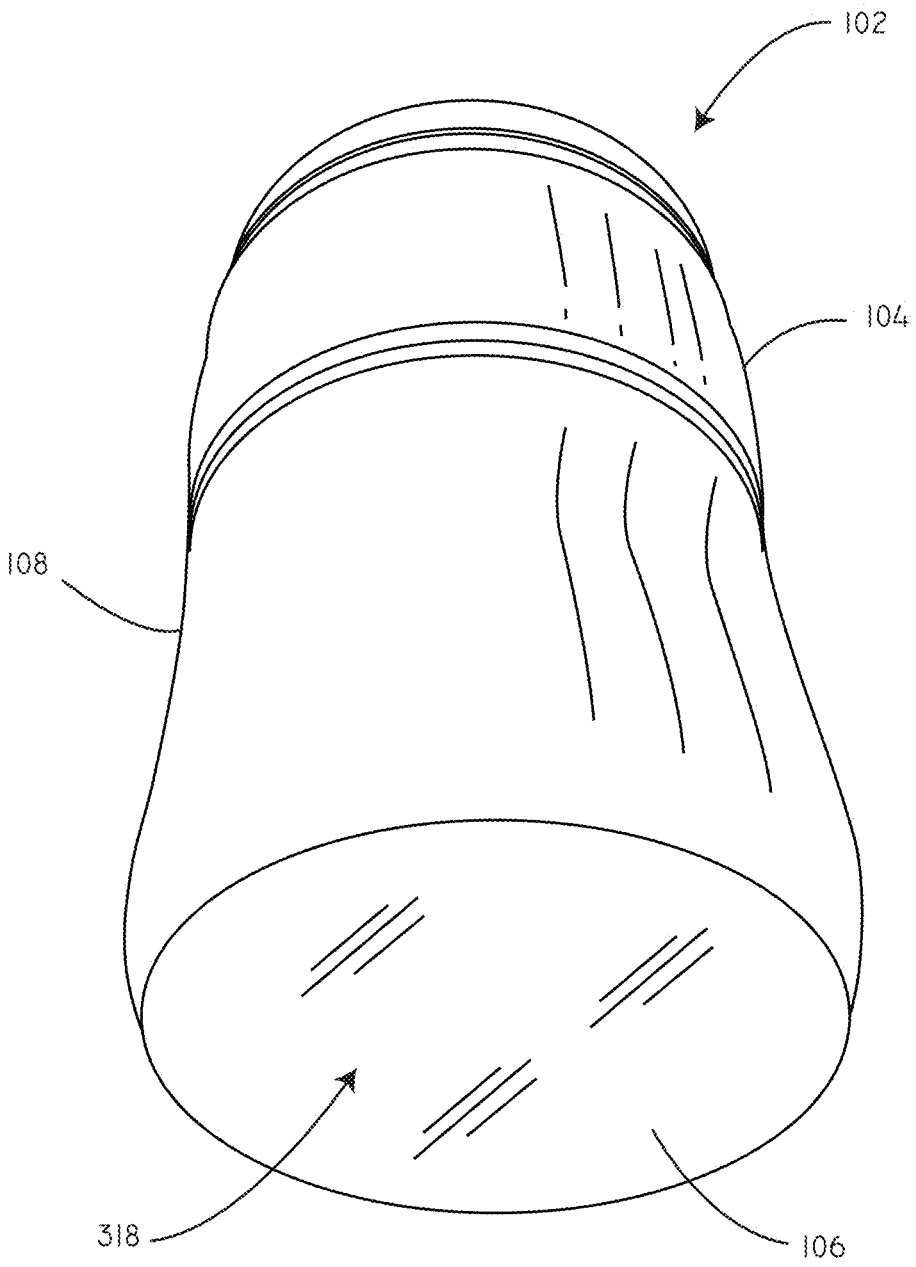
FIG. 4 is a schematic perspective view of a microwaveable food product and container in accordance with various embodiments herein.

Referring now to FIG. 4, a schematic perspective view is shown of the bottom of a microwaveable food product 102. The food product 102 includes a container 104. The container 104 includes a bottom wall 318 and a side wall 108. The bottom wall 318 includes a microwave reflector 106 disposed thereon.

Figure 5:
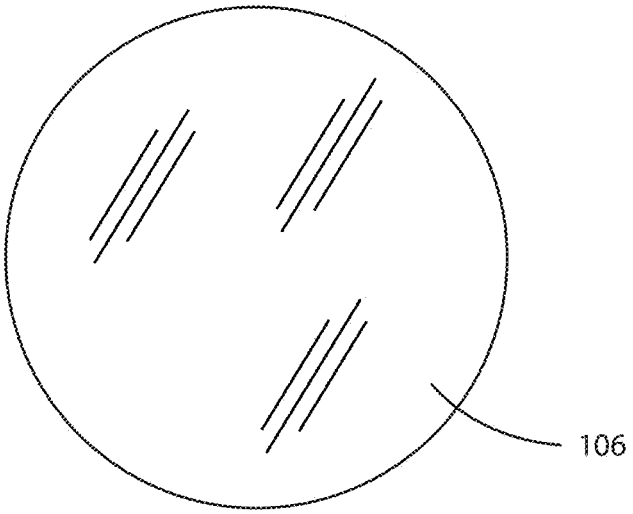
FIG. 5 is a plan view of a microwave reflector in accordance with various embodiments herein.

Referring now to FIG. 5, a plan view of a microwave reflector 106 is shown in accordance with various embodiments. In this embodiment the microwave reflector 106 lacks cut lines.

Figure 6:
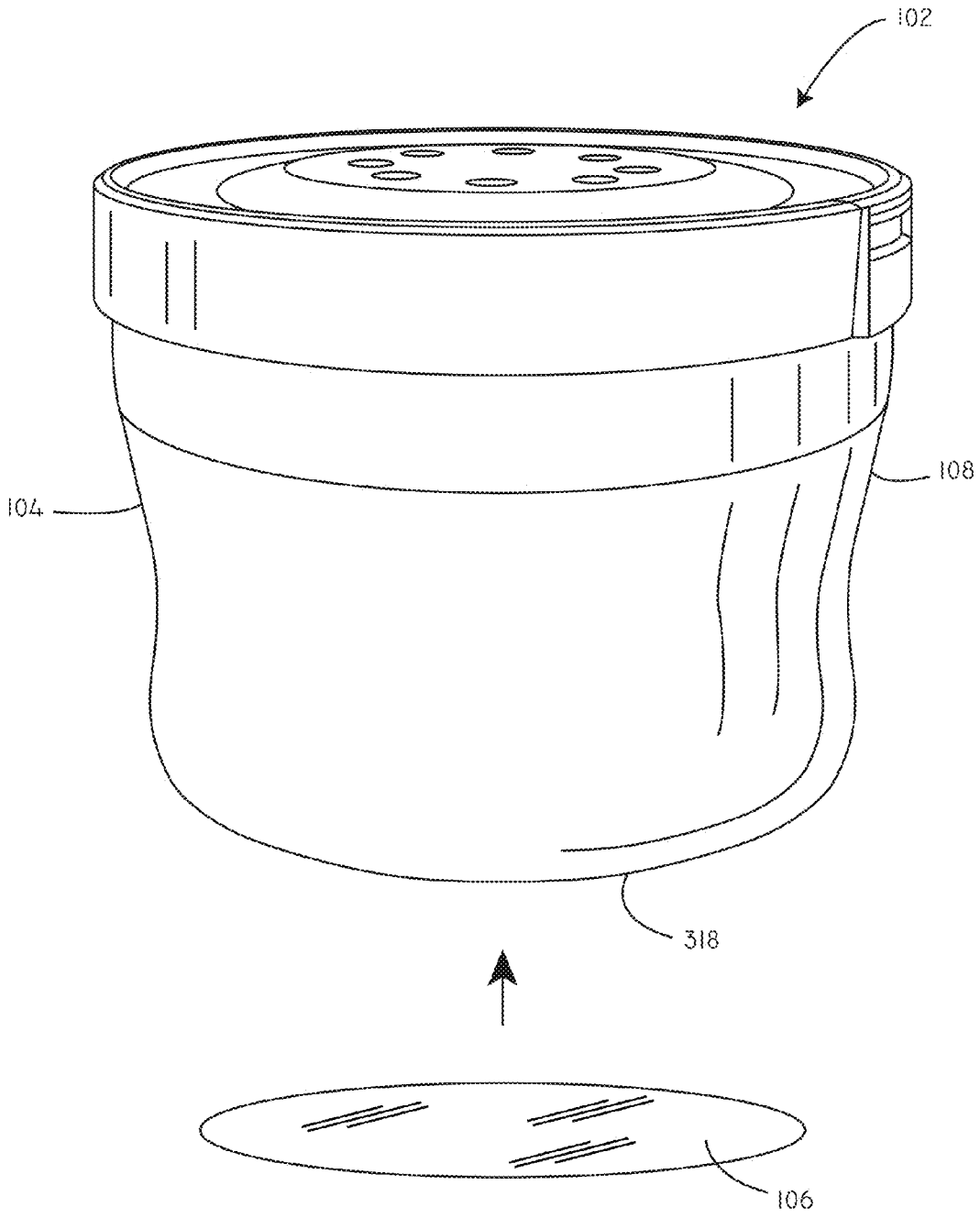
FIG. 6 is a schematic perspective view of a microwaveable food container in accordance with various embodiments herein.

Referring now to FIG. 6, a schematic perspective view of a microwaveable food container is shown in accordance with various embodiments herein. The food product 102 includes a container 104. The container 104 includes a bottom wall 318 and a side wall 108. In this view the bottom wall 318 has a larger diameter relative to the side wall 108 (versus the configuration shown in FIG. 1) giving it dimensions consistent with a bowl. The bottom wall 318 includes a microwave reflector 106. The microwave reflector 106 can be a pressure sensitive adhesive label that is applied onto the bottom wall 318 as shown in FIG. 6.

Figure 7:
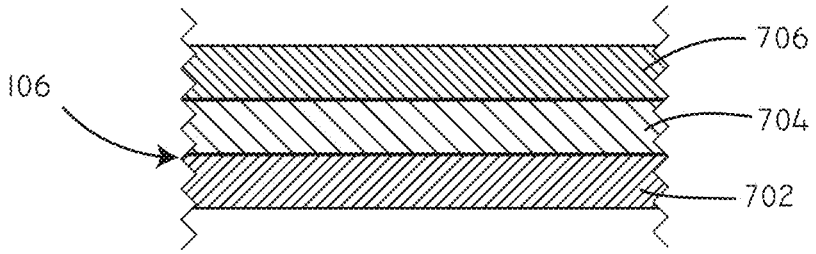
FIG. 7 is a cross-sectional view of a microwaveable reflector in accordance with various embodiments herein.

Referring now to FIG. 7, a cross-sectional view of an exemplary microwave reflector is shown in accordance with various embodiments herein. The microwave reflector 106 can include a substrate layer 702. In some embodiments, the substrate layer 702 is a cellulosic material such as paper. In other embodiments, the substrate layer 702 can be a polymer. However, in some embodiments, the substrate layer 702 may be omitted. The microwave reflector 106 can also include a layer of a reflective material, such as a metal. In this embodiment, the layer of reflective material is a layer of aluminum 704. The layer of aluminum 704 can be disposed on the substrate layer 702. However, in other embodiments, the layer of aluminum 704 could be below the substrate layer 702.

The reflective material can be of various thicknesses. In some embodiments, the layer of reflective material can have a thickness of about 2 microns to about 10 microns. In some embodiments, the layer of reflective material can have a thickness of about 5 microns.

In some embodiments, the layer of reflective material 704 lacks pinholes. In some embodiments, the microwave reflector can be continuous across the bottom of the container in order to prevent possible arcing issues. In other embodiments, the layer of reflective material has a plurality of holes or apertures.

A layer of adhesive 706 can be disposed on top of the microwave reflector 106. In some embodiments, the adhesive 706 is applied to the microwave reflector 106 and then the microwave reflector 106 is applied to the bottom of the container. In other embodiments, the adhesive 706 is applied to the bottom of the container first and then the microwave reflector 106 is applied to the bottom of the container. The layer of adhesive can include a low outgassing adhesive. The layer of adhesive can include a pressure sensitive adhesive. The layer of adhesive can include a thermally stable adhesive.

In some embodiments, the reflector could be incorporated into the container through in-mold techniques associated with container manufacture by replacing the adhesive with a material of the same polymer as the container outer surface and bonding the two components together. Also, in some embodiments, the reflector can be bonded to the container without using an adhesive through various techniques such as sonic welding.

Figure 8:
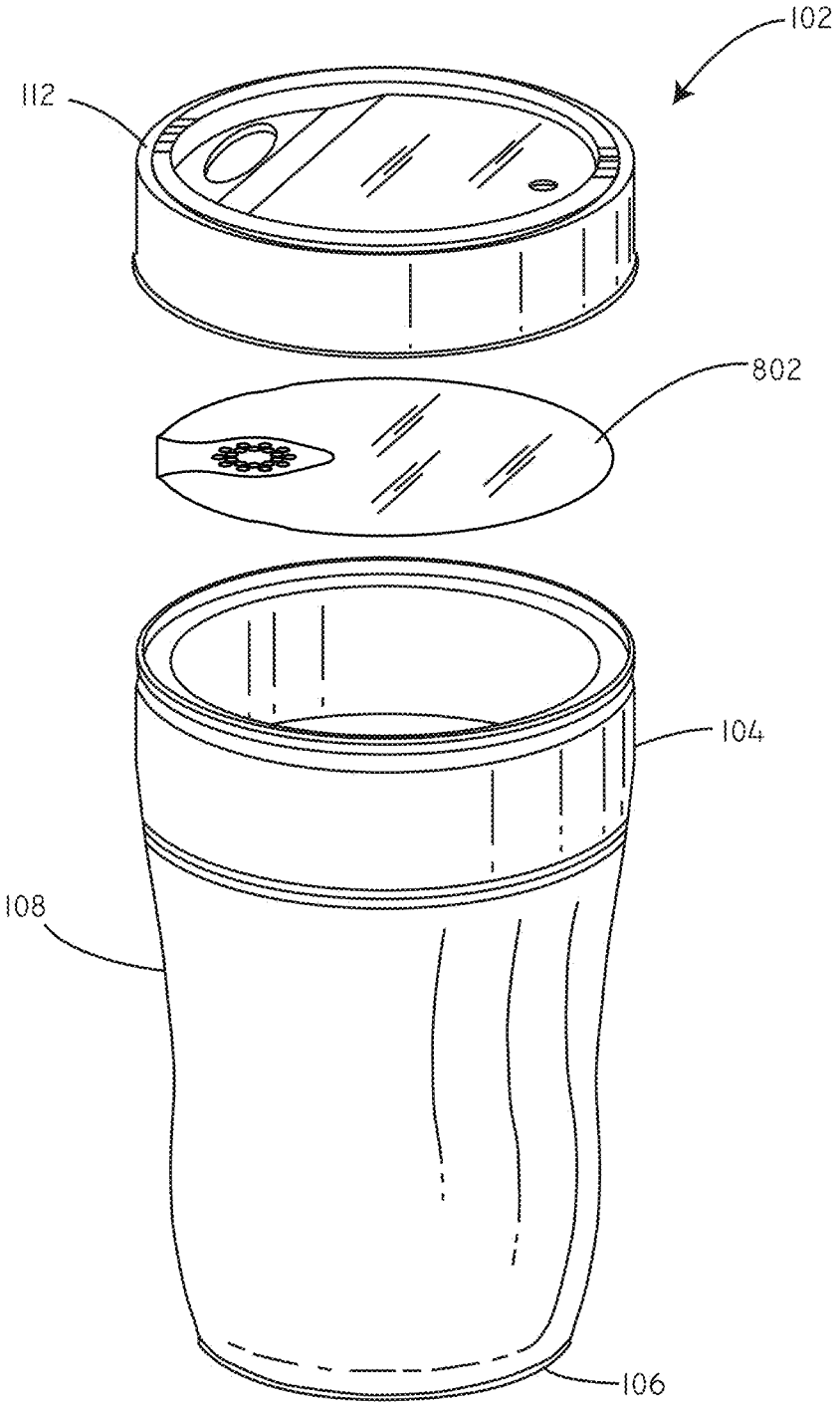
FIG. 8 is a schematic exploded view of a microwaveable food product and container in accordance with various embodiments herein.
Figure 9A:
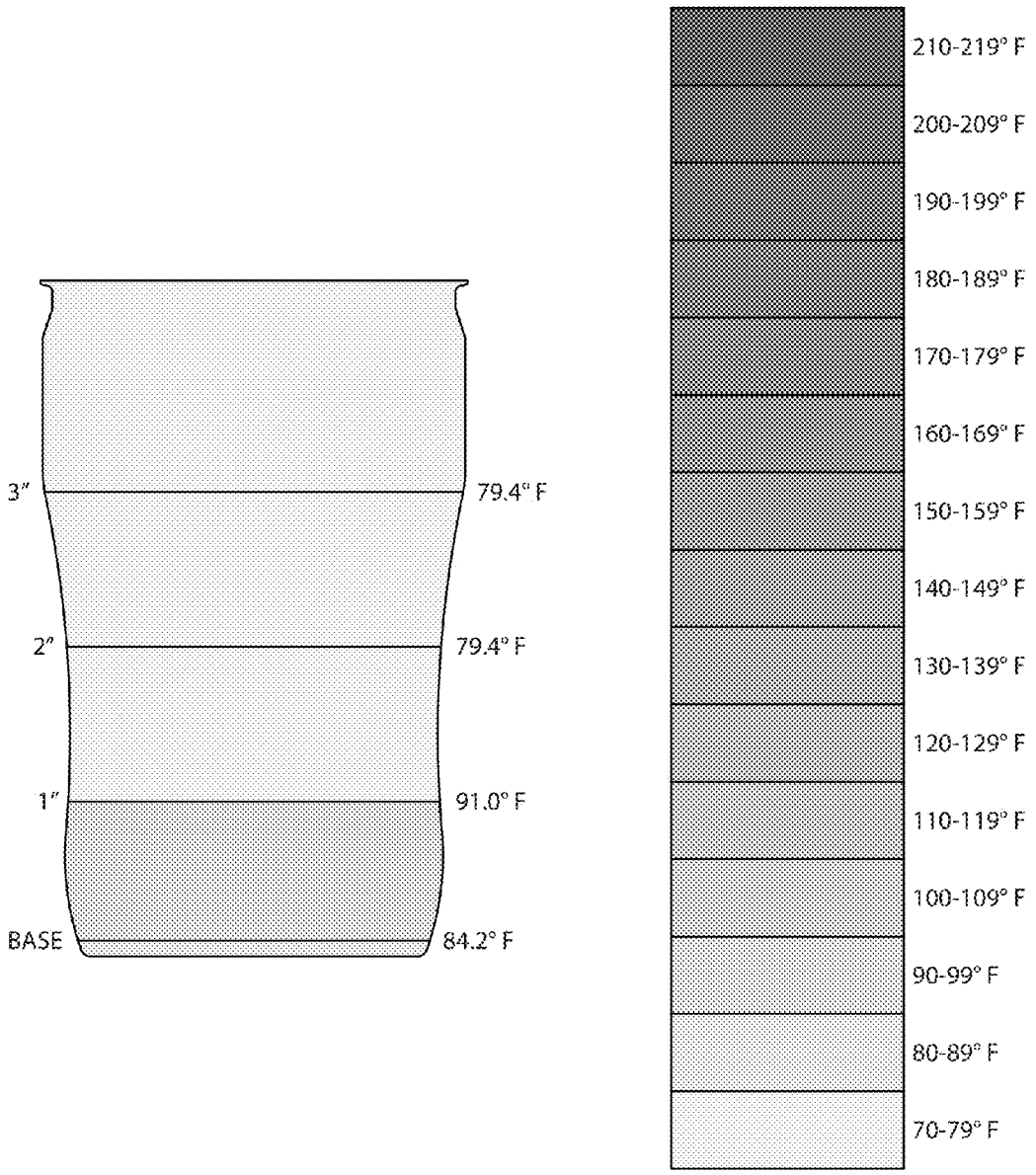
FIG. 9A is a schematic representation of temperature gradients within a food container having no reflector on the bottom after 20 seconds of microwaving.
Figure 9B:
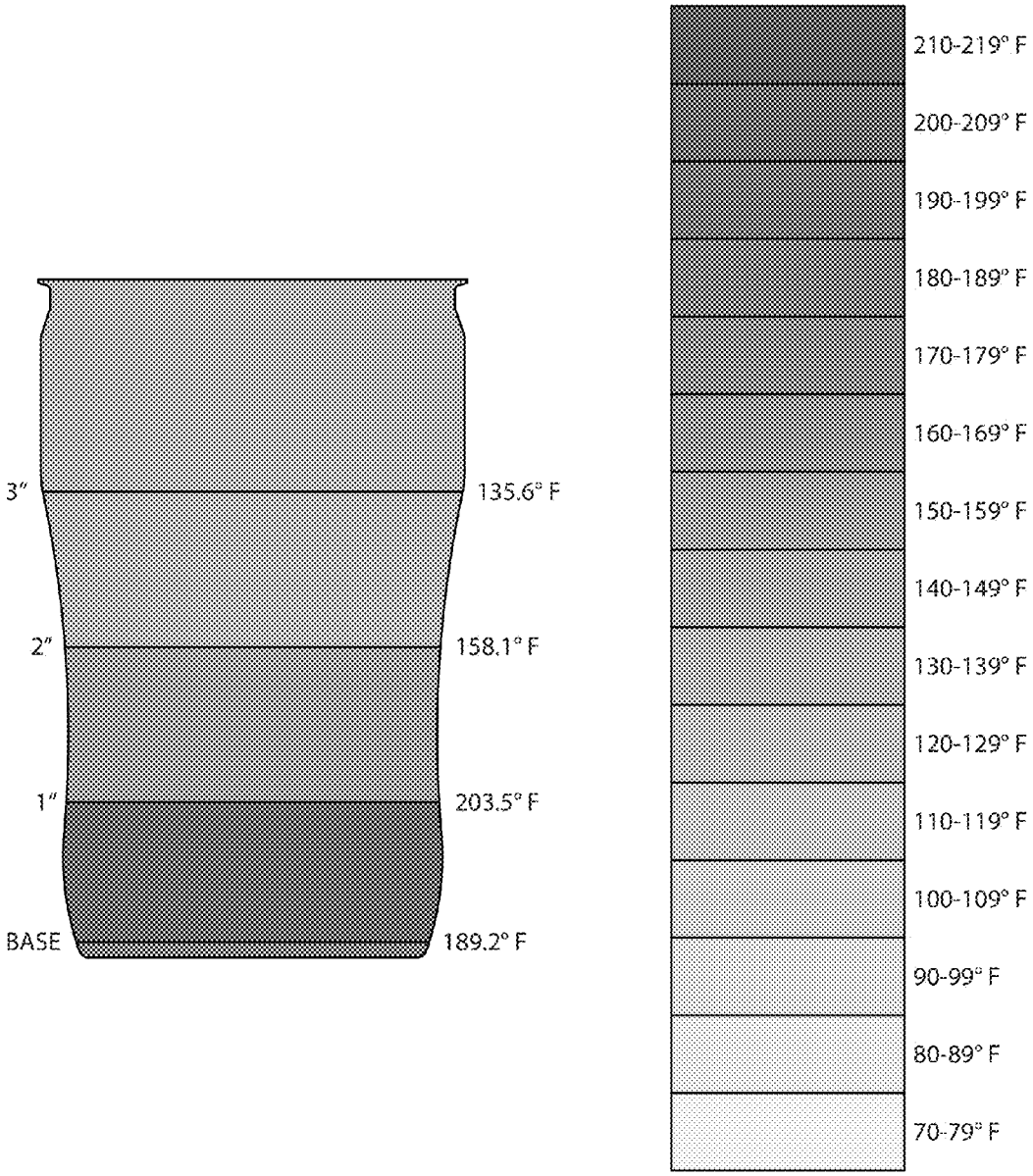
FIG. 9B is a schematic representation of temperature gradients within a food container having no reflector on the bottom after 90 seconds of microwaving.
Figure 10A:
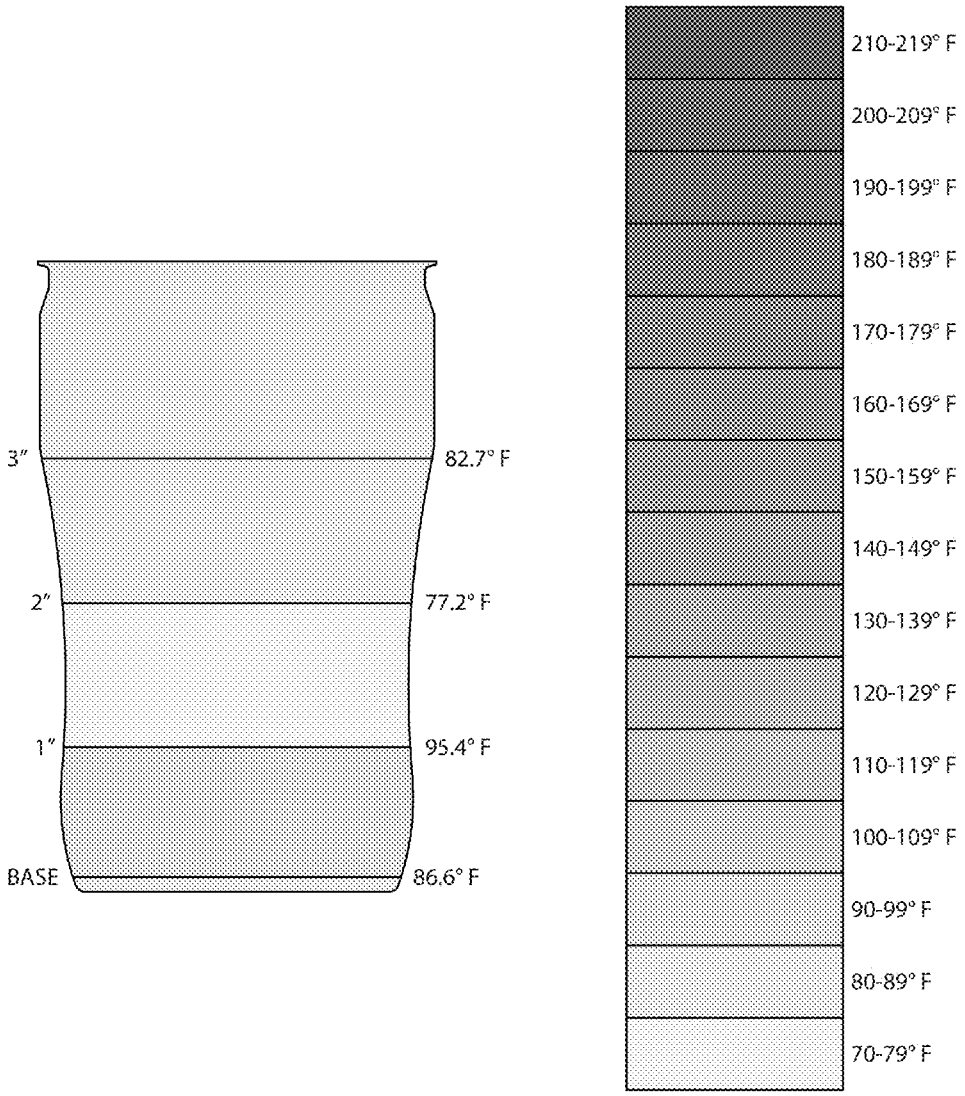
FIG. 10A is a schematic representation of temperature gradients within a food container having a microwave reflector on the bottom after 20 seconds of microwaving.
Figure 10B:
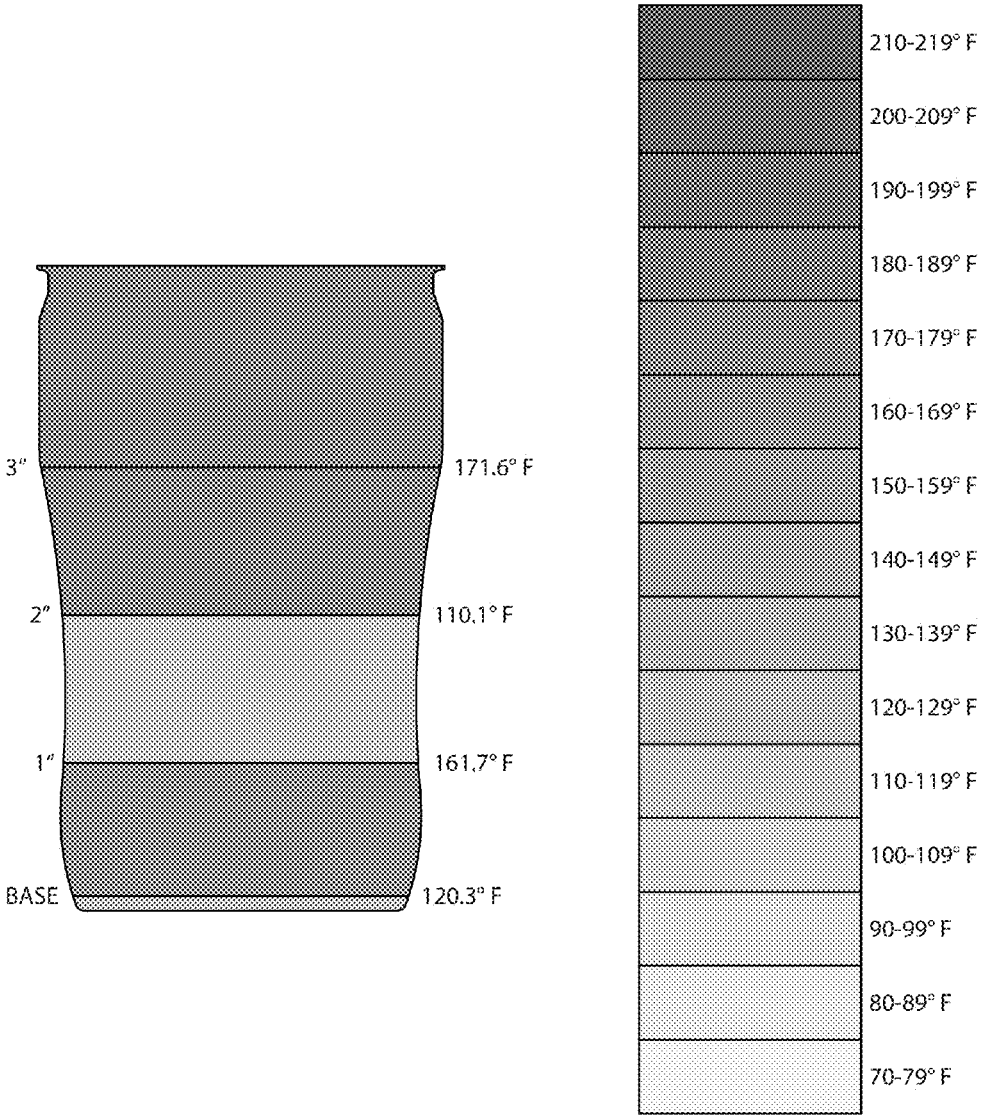
FIG. 10B is a schematic representation of temperature gradients within a food container having a microwave reflector on the bottom after 90 seconds of microwaving.

Referring now to FIG. 8, a schematic exploded view of a microwaveable food product and container is shown in accordance with various embodiments herein. The food product 102 includes a container 104. The container 104 includes a side wall 108. The container 104 includes a microwave reflector 106. The food product 102 can also include a removable cap 112. The food product 102 can include a membrane seal 802 that can function to seal the food content within the container 104 until the time for microwave heating and/or subsequent consumption.

In some embodiments, the microwave reflector is effective to reflect at least about 50 percent of the microwaves incident upon the surface of the microwave reflector. In some embodiments, the microwave reflector is effective to reflect at least about 70 percent of the microwaves incident upon the surface of the microwave reflector. In some embodiments, the microwave reflector is effective to reflect at least about 90 percent of the microwaves incident upon the surface of the microwave reflector. In some embodiments, the microwave reflector is effective to reflect at least about 95 percent of the microwaves incident upon the surface of the microwave reflector. In some embodiments, the microwave reflector is effective to reflect at least about 99 percent of the microwaves incident upon the surface of the microwave reflector.

The side walls and/or bottom wall can include a material that is substantially transparent to microwave radiation. In some embodiments, the material that is substantially transparent to microwaves is a polymer, such as a polyolefin polymer. In some embodiments, the material that is substantially transparent to microwaves is specifically a polyethylene polymer. In some embodiments, the material that is substantially transparent to microwaves is specifically a polypropylene polymer. It will be appreciated that many different polymers can be used.

In some embodiments, the side walls can be substantially transparent to microwave radiation. For example, in some embodiment, at least 60% of the surface area of the side walls is substantially transparent to microwave radiation (stated alternately, at least 60% of the surface area of the side walls can be without a microwave reflector and/or a substantial absorber). In some embodiments, at least about 70% of the surface area of the side walls can be transparent to microwave radiation. In some embodiments, at least about 80% of the surface area of the side walls can be transparent to microwave radiation. In some embodiments, at least about 90% of the surface area of the side walls can be transparent to microwave radiation. In some embodiments, at least about 95% of the surface area of the side walls can be transparent to microwave radiation. In some embodiments, at least about 98% of the surface area of the side walls can be transparent to microwave radiation. In some embodiments, at least about 99% of the surface area of the side walls can be transparent to microwave radiation. In some embodiments, 100% of the surface area of the side walls can be transparent to microwave radiation.

In some embodiments, the side walls and/or bottom wall can include more than one material. In some embodiments, the side walls and/or bottom wall can include a material or lining that prevents ingress or egress of gases such as oxygen.

Containers in accordance with embodiments herein can have various dimensions. In some embodiments, the height of the container is greater than about 5 cm. In some embodiments, the height of the container is greater than about 7 cm. In some embodiments, the height of the container is greater than about 9 cm. In some embodiments, the height of the container is less than about 16 cm. In some embodiments, the height of the container is less than about 14 cm. In some embodiments, the height of the container is less than about 13 cm. In some embodiments, the height of the container is between about 5 cm and about 16 cm. In some embodiments, the height of the container is between about 7 cm and about 14 cm. In some embodiments, the height of the container is between about 9 cm and about 13 cm. In some embodiments, the height of the container is about 11 cm.

In some embodiments, the diameter of the container is greater than about 4 cm. In some embodiments, the diameter is greater than about 6 cm. In some embodiments, the diameter is greater than about 8 cm. In some embodiments, the diameter is less than about 16 cm. In some embodiments, the diameter is less than about 14 cm. In some embodiments, the diameter is less than about 12 cm. In some embodiments, the diameter is between about 4 cm and about 16 cm. In some embodiments, the diameter is between about 6 cm and about 14 cm. In some embodiments, the diameter is between about 8 cm and about 12 cm. In some embodiments, the diameter is about 10 cm.

Containers that are relatively tall for their base width are at in increased risk of tipping over as a result of localized superheating near the bottom of the container. In some embodiments, the ratio of the height of the side wall to the diameter of the bottom wall is from about 2.0 to about 1.6. However, it will be appreciated that embodiments herein can also include containers that have relatively larger bases and are therefore more stable. In some embodiments, the ratio of the height of the side wall to the diameter of the bottom wall is from about 0.5 to about 1.2.

The container can have various specific volumes. In some embodiments, the volume of the container can be greater than 50 ml, 100 ml, 200 ml, 300 ml, or 500 ml as a lower bound. In some embodiments, the volume of the container can be less than 2000 ml, 1000 ml, 500 ml, 400 ml, or 300 ml as an upper bound. In some embodiments, the volume can be in a range between any of the lower and upper bounds above.

The food composition can include various components. The food composition can include solid matter. The solid matter can include components such as vegetables, meat, noodles, and the like. In various embodiments, the solid matter settles to the bottom of the container. The food composition can also include a liquid portion. The liquid portion can include broth. The liquid can include water. The liquid can include various soluble components. In some embodiments, at least about 50% by weight of the food composition is solid matter disposed within a liquid.

Food products and containers herein can be effective to prevent localized superheating in the area near the bottom of the container. In some embodiments, the temperature of the food composition adjacent the bottom wall remains at a temperature of less than about 180 degrees after 90 seconds of microwaving at the highest setting in a 1200 watt (IEC 705) microwave oven.

In some embodiments, methods of making a food product and/or container are included herein. Methods can include applying a microwave reflector to the bottom wall of a container. In some embodiments, the method can include applying the microwave reflector to the outside surface of the bottom wall. The microwave reflector can cover the surface area of the bottom wall as described above. Methods can also include filling a container with a food composition. Filling the container can take place either before or after applying the microwave reflector to the bottom wall of the container.

The present invention may be better understood with reference to the following examples. These examples are intended to be representative of specific embodiments of the invention, and are not intended as limiting the scope of the invention.

EXAMPLES

Example 1

Reflector with Creamy Tomato Soup in a Cup

In this experiment, a creamy tomato soup in a microwaveable cup (11 cm height and 5 cm diameter) was used to evaluate the effectiveness of a microwave reflector. Two samples: (1) Control—no reflector at the bottom, and (2) Test—with reflector covering 100% of the bottom, were tested. In each sample cup, four fiber optic temperature sensors were placed at approximately 1" intervals starting at the bottom of the cup close to the side of the cup. Each sample was heated in a 1200-watt microwave oven equipped with turntable for 90 seconds with a 1 minute stand time. Rise in temperature of soup at different depths was recorded using fiber optic temperature sensors. After heating, the cup was removed, the sample stirred and the final temperature measured.

The typical temperature gradients are depicted in FIGS. 9A, 9B, 10A, and 10B. Temperature gradients exist and typical temperatures within a zone are affected by localized conduction, convection and microwave activity. As shown in the figures, at 90 seconds, the test sample with microwave reflector attached to the bottom showed much lower temperature at the bottom (120° F.) compared to control sample (190° F.), clearly reducing super heating at the bottom. The final stirred temperatures are similar for both, control and test products, 158° F. and 156° F., respectively. Thus a microwave reflector at the bottom promotes more uniform heating in the product and reduces localized superheating at the bottom.

Example 2

Reflector with Vegetable Soup in a Cup

In this example, a vegetable soup made of vegetable broth and solid garnish components (noodles and vegetables such as carrots, corn, celery) was selected to study the effectiveness of a microwave reflector in reducing microwave activity (tipping). The soup contained approximately 15% garnish by weight. The soup was packaged in microwaveable cup (11.6 cm height and 5.7 cm bottom diameter). A set of 48 samples each: (1) Control—no microwave reflector at the bottom, (2) Test—with microwave reflector covering 100% of the bottom were evaluated by heating for 90 seconds in a 1200-watt microwave oven. During heating, samples were evaluated for microwave activity (bumps, movement, splatter and tips) and assigned a microwave activity score.

The microwave activity score was calculated as follows (and shown below): the sum of 1*number of bumps; 3*number of movements; 2*number of splatters; and 10*number of tips.

| Event | Multiplier | Subscore |
|---|---|---|
| Number of Bumps | 1 | W |
| Number of Movements | 3 | X |
| Number of Splatters | 2 | Y |
| Number of Tips | 10 | Z |
| | Total Activity Score = | W + X + Y + Z |

Figure 11:
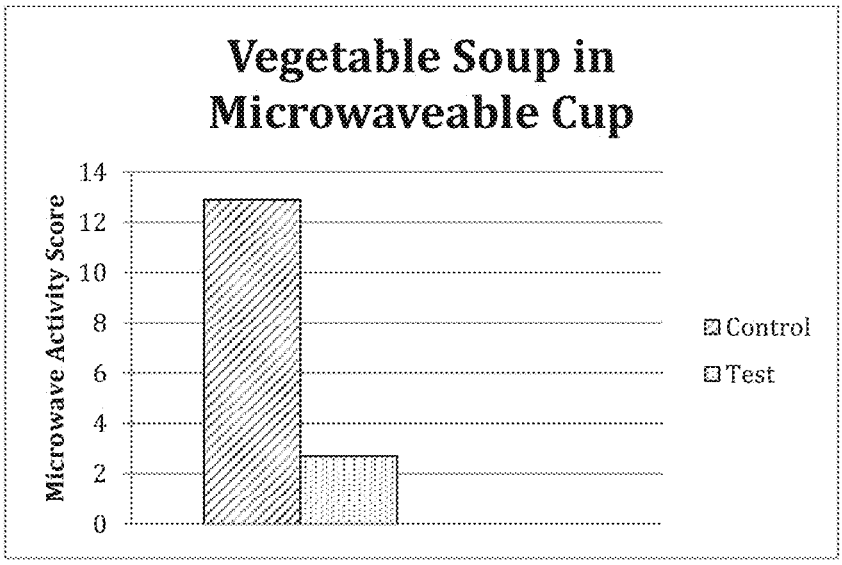
FIG. 11 is a graph showing microwave activity scores for a vegetable soup in microwavable cups with and without a microwave reflector on the bottom.

The average microwave activity score was reported. The results are shown in FIG. 11 and clearly indicate that the test samples with microwave reflector at the bottom showed no/or very little microwave activity, compared to control samples.

Example 3

Reflector with Meat Soup in a Bowl

A meat broth based soup containing solid garnish components (such as meat, carrots, potatoes, green beans, peas) was used to study the effectiveness of microwave reflector. The soup contained 50% garnish by weight. The soup was packaged in a microwaveable bowl (8 cm height and 8 cm bottom diameter). A set of 48 samples each for: (1) Control—no microwave reflector at the bottom, (2) Test—with the microwave reflector attached at the bottom were evaluated by heating for 120 sec in a 1200-watt microwave oven.

Figure 12:
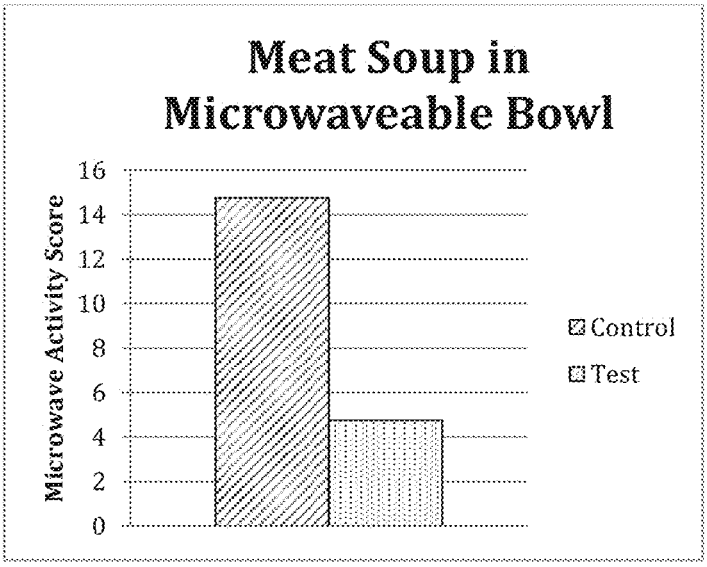
FIG. 12 is a graph showing microwave activity scores for a meat soup in microwavable bowls with and without a microwave reflector on the bottom.

During heating, samples were evaluated for microwave activity (bumps, movement, splatter and tips) and assigned a microwave activity score (according to the scoring system described above in Example 2). The results are shown in FIG. 12 and clearly indicate that the test samples with microwave reflector at the bottom showed significantly reduced microwave activity compared to control samples.

Example 4

Reflector with Vegetable Soup in a Cup

In this example, a vegetable soup with solid garnish components (noodles and vegetables such as carrots, corn, celery) was heated in microwave ovens with varying wattage (800 and 1200 watts) to study the effectiveness of microwave reflector. The soup contained approximately 15% garnish by weight and was packaged in microwaveable cup (11.6 cm height and 5.7 cm bottom diameter). A set of 5 samples each: (1) Control—no microwave reflector at the bottom, (2) Test—with microwave reflector attached at the bottom, were used for test. Samples were heated for 90 seconds in 800-watt and 1200-watt microwave ovens and evaluated for microwave activity (bumps, movement, splatter and tips) as described above. The microwave reflector was found to be equally effective across microwave ovens (800 and 1200 watt), in reducing microwave activity.

Example 5

Reflector with Vegetable Soup in a Cup

In this example, the effectiveness of reflector covering 50-100% area of the bottom of the container was evaluated using a vegetable soup with solid garnish components. The soup contained approximately 15% garnish by weight. The soup was packaged in microwaveable cup (11.6 cm height and 5.7 cm bottom diameter). A set of 10 samples each: (1) Control—no microwave reflector at the bottom, (2) Test 1—100% bottom covered with microwave reflector (60 mm diameter), (3) Test 2—50% bottom covered microwave reflector (30 mm diameter) attached at the center, and (4) Test 3—50% of the bottom covered with a doughnut center hole were tested. The samples were heated for 90 seconds in 1200-watt microwave oven and evaluated for microwave activity (bumps, movement, splatter and tips) and assigned a microwave activity score according to the procedure describe above in Example 2.

Figure 13:
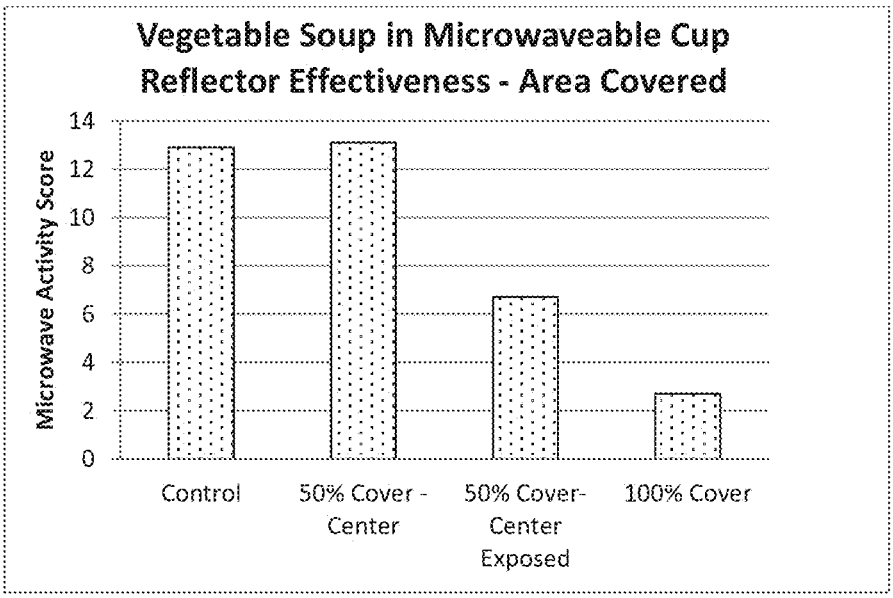
FIG. 13 is a graph showing microwave activity scores for a vegetable soup with different configurations of bottom reflector coverage.

The results are shown in FIG. 13 and indicate that the sample with 100% covered bottom is the most effective, with very little microwave activity score, followed by covering the 50% of bottom area, but leaving the center exposed. Covering 50% of the area at the bottom center alone did not have any effect in comparison to the control.

Example 6

Variation of Oven Wattage

Embodiments herein have been found to perform in a consistent and repeatable way across a range of microwave oven power outputs, oven sizes (cubic capacity) and dimensions (oven cavity shapes), confirming the technology works for typical household microwaves operating in the range of 600 to 1200 W as well as larger industrial models. The rating of a microwave's power is based on a calorimetric calibration test method, heating a defined mass of water over a time and change in temperature, testing methodology as determined by either by International standard IEC 705 or the IMPI (International Microwave Power Institute) standard in the USA. The power density, which is determined by energy output over a time period, and relative to the volume of the microwave cavity and position of the load within the cavity, does not influence the functionality of embodiments herein, other than the potential for a final temperature variation from different heating times.

It should be noted that, as used in this specification and the appended claims, the singular forms 'a,' 'an,' and 'the' include plural referents unless the content clearly dictates otherwise. Thus, for example, reference to a composition containing 'a compound' includes a mixture of two or more compounds. It should also be noted that the term 'or' is generally employed in its sense including 'and/or' unless the content clearly dictates otherwise.

It should also be noted that, as used in this specification and the appended claims, the phrase 'configured' describes a system, apparatus, or other structure that is constructed or configured to perform a particular task or adopt a particular configuration to. The phrase 'configured' can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific and preferred embodiments and techniques. However, it should be understood that many variations and modifications may be made while remaining within the spirit and scope of the invention.

Further Embodiments

In an embodiment, a food product is included. The food product can include a container. The container can include a bottom wall including a microwave reflector. The microwave reflector covers at least about 80 percent of the surface area of the bottom wall. The container can also include a side wall connected to the bottom wall, the side wall including a material that is substantially transparent to microwaves. The food product can also include a food composition disposed in the container.

In some embodiments, the microwave reflector is disposed on the outside of the bottom wall. In some embodiments, the container further includes a layer of adhesive disposed between the outside of the bottom wall and the microwave reflector.

In some embodiments, the microwave reflector is disposed on the inside of the bottom wall. In some embodiments, the microwave reflector is embedded within the bottom wall. In some embodiments, the microwave reflector covers at least about 90 percent of the surface area of the bottom wall. In some embodiments, the microwave reflector covers at least about 99 percent of the surface area of the bottom wall. In some embodiments, the bottom wall has a perimeter and the microwave reflector covers 100% of the area within 1 cm of the perimeter of the bottom wall.

In some embodiments, the peripheral edge of the reflector including a plurality of cut lines oriented radially with respect to the center of the reflector. In some embodiments, the reflector includes a layer of aluminum. In some embodiments, the layer of aluminum has a thickness of about 2 microns to about 10 microns. In some embodiments, the reflector is a pressure sensitive adhesive label. In some embodiments, the reflector has a circular shape.

In some embodiments, the material that is substantially transparent to microwaves includes a polyolefin polymer. In some embodiments, the material that is substantially transparent to microwaves includes a polyethylene polymer. In some embodiments, the material that is substantially transparent to microwaves includes a polypropylene polymer. In some embodiments, the bottom wall includes a layer of material that is substantially transparent to microwaves. In some embodiments, the material that is substantially transparent to microwaves includes a polyolefin polymer.

In some embodiments, the side wall is circular in cross-section. In some embodiments, the side wall has a height of between about 5 cm to about 14 cm. In some embodiments, the ratio of the height of the side wall to the diameter of the bottom wall is from about 2.0 to about 1.6. In some embodiments, the ratio of the height of the side wall to the diameter of the bottom wall is from about 0.5 to about 1.2. In some embodiments, the bottom wall has a diameter of between about 4 cm to about 15 cm.

In some embodiments, at least about 50% by weight of food composition is solid matter disposed within a liquid. In some embodiments, the solid matter settles to the bottom of the container. In some embodiments, the microwave reflector is effective to reflect as least about 90 percent of the microwaves incident on the surface of the microwave reflector. In some embodiments, the temperature of the food composition adjacent the bottom wall remains at a temperature of less than about 180 degrees after 90 seconds of microwaving at the highest setting in a 1200 watt microwave.

In an embodiment, a food container is included. The food container can include a bottom wall, the bottom wall including a microwave reflector. The microwave reflector can cover at least about 80 percent of the surface area of the bottom wall. The food container can also include a side wall connected to the bottom wall, the side wall including a material that is substantially transparent to microwaves. The microwave reflector can be disposed on the outside of the bottom wall. The container can further include a layer of adhesive disposed between the outside of the bottom wall and the microwave reflector. The microwave reflector can be disposed on the inside of the bottom wall. The microwave reflector can be embedded within the bottom wall. The microwave reflector can cover at least about 90 percent of the surface area of the bottom wall. The microwave reflector can cover at least about 99 percent of the surface area of the bottom wall. The peripheral edge of the reflector can include a plurality of cut lines oriented radially with respect to the center of the reflector.

The invention claimed is:

1. A food product comprising:

a container, the container comprising a bottom wall, the bottom wall comprising a microwave reflector, wherein the microwave reflector covers at least about 80 percent of a surface area of the bottom wall;

a side wall connected to the bottom wall at a fixed angle the side wall comprising a material allowing the passage of microwaves there through, wherein the bottom wall and the side wall define an interior volume; and a food composition, wherein the food composition fills the interior volume, the food composition comprising a water-containing liquid and solid matter disposed within the water-containing liquid at a bottom of the interior volume; the side wall having a height and the bottom wall having a diameter, wherein a ratio of the height of the side wall to the diameter of the bottom wall is from about 0.5 to about 1.2 or from about 2.0 to about 1.6;

wherein the microwave reflector is effective to shield microwave radiation thereby preventing localized superheating of the solid matter disposed at a bottom of the food composition;

wherein at least a portion of the solid matter has settled at the bottom of the container.

2. The food product of claim 1, wherein the microwave reflector is disposed on an outside of the bottom wall.

3. The food product of claim 1, wherein the microwave reflector covers at least about 90 percent of the surface area of the bottom wall.

4. The food product of claim 1, wherein the microwave reflector covers at least about 99 percent of the surface area of the bottom wall.

5. The food product of claim 1, the bottom wall having a perimeter, wherein the microwave reflector covers 100% of the area within 1 cm of the perimeter of the bottom wall.

6. The food product of claim 1, wherein the microwave reflector is a pressure sensitive adhesive label.

7. The food product of claim 1, wherein the side wall is circular in cross-section.

8. The food product of claim 1, the side wall having a height of between about 5 cm to about 14 cm.

9. The food product of claim 1, the bottom wall having a diameter of between about 4 cm to about 15 cm.

10. The food product of claim 1, wherein at least about 50% by weight of food composition is solid matter disposed within a liquid.

11. The food product of claim 10, wherein the solid matter settles to the bottom of the container.

12. The food product of claim 1, wherein the microwave reflector is effective to reflect at least about 90 percent of the microwaves incident on a surface of the microwave reflector.

13. The food product of claim 1, wherein the food composition adjacent the bottom wall remains at a temperature of less than about 180 degrees Fahrenheit after 90 seconds of microwaving at the highest setting in a 1200 watt microwave.

14. The food product of claim 1, the food composition comprising soup.

15. The food product of claim 1, wherein the internal volume filled by the food composition is from 100 ml to 2000 ml.

16. The food product of claim 1, the microwave reflector defining cut lines oriented radially with respect to a center of the microwave reflector.

17. The food product of claim 1, wherein the interior volume is completely filled with the food composition to a height of greater than 2 inches.

18. The food product of claim 1, wherein the interior volume is completely filled with the food composition to a height of greater than 3 inches.

19. The food product of claim 1, wherein all of the solid matter is completely immersed within the water-containing liquid.

20. The food product of claim 1, wherein the microwave reflector is embedded within the bottom wall.

21. The food product of claim 1, wherein the microwave reflector is disposed on an inside of the bottom wall.

22. A food product comprising:

a container, the container comprising a bottom wall, the bottom wall comprising a microwave reflector, wherein the microwave reflector covers at least about 80 percent of a surface area of the bottom wall;

a side wall connected to the bottom wall at a fixed angle the side wall comprising a material allowing the passage of microwaves there through, wherein the bottom wall and the side wall define an interior volume; and a food composition, wherein the food composition fills the interior volume, the food composition comprising a water-containing liquid and solid matter disposed within the water-containing liquid at a bottom of the interior volume; the side wall having a height and the bottom wall having a diameter, wherein a ratio of the height of the side wall to the diameter of the bottom wall is from about 0.5 to about 1.2 or from about 2.0 to about 1.6;

wherein the microwave reflector is effective to shield microwave radiation thereby preventing localized superheating of the solid matter disposed at a bottom of the food composition;

wherein at least 60% of a surface area of the side wall of the container is transparent to microwaves.

23. The food product of claim 22, wherein at least 95% of the surface area of the side wall of the container is transparent to microwaves.

* * * * *